US008727023B2

(12) United States Patent
Heijnen

(10) Patent No.: US 8,727,023 B2
(45) Date of Patent: May 20, 2014

(54) WIRELINE LUBRICATOR

(75) Inventor: Wilhelmus Hubertus Paulus Maria Heijnen, Stromberg (DE)

(73) Assignee: Maersk Olie Og Gas A/S, Copenhagen K (DK)

( * ) Notice: Subject to any disclaimer, the term of this patent is extended or adjusted under 35 U.S.C. 154(b) by 387 days.

(21) Appl. No.: 13/003,470

(22) PCT Filed: Jul. 2, 2009

(86) PCT No.: PCT/EP2009/058343

§ 371 (c)(1), (2), (4) Date: May 5, 2011

(87) PCT Pub. No.: WO2010/003879

PCT Pub. Date: Jan. 14, 2010

(65) Prior Publication Data

US 2011/0220368 A1 Sep. 15, 2011

Related U.S. Application Data

(60) Provisional application No. 61/080,136, filed on Jul. 11, 2008.

(30) Foreign Application Priority Data

Jul. 11, 2008 (DK) ..... 2008 00974

(51) Int. Cl.
*E21B 33/02* (2006.01)
*E21B 23/14* (2006.01)

(52) U.S. Cl.
USPC ..... 166/381; 166/85.1; 166/84.2; 166/92.1

(58) Field of Classification Search
USPC ..... 166/381, 84.1–84.5, 85.1, 85.3–85.5, 166/77.1, 92.1, 75.11; 414/22.58, 22.54
See application file for complete search history.

(56) References Cited

U.S. PATENT DOCUMENTS

| | | | |
|---|---|---|---|
| 1,130,181 | A | 3/1915 | Bower |
| 1,509,906 | A | 9/1924 | Sawtelle |
| 1,664,643 | A | 4/1928 | Rasmussen |

(Continued)

FOREIGN PATENT DOCUMENTS

| | | | |
|---|---|---|---|
| EP | 0 681 353 | B1 | 11/1995 |
| GB | 2 071 599 | A | 9/1981 |

OTHER PUBLICATIONS

Dictionary definitions of "telescopic" and "aperture", accessed Apr. 16 2013 via www.thefreedictionary.com.*

(Continued)

*Primary Examiner* — Blake Michener
(74) *Attorney, Agent, or Firm* — Brinks Gilson & Lione

(57) ABSTRACT

A wireline lubricator and a connector includes a first part with a first seal portion and a first throughgoing passage for receiving a part of a wireline, and a second part with a second seal portion and a second throughgoing passage for receiving a part of a wireline. The first part is pivotally connected to the second part such that the connector is capable of assuming a first configuration and a second configuration. The second configuration and the first and second throughgoing passage are aligned. The first and second seal portion engage each other to provide a sealed wireline passage defined by the aligned first and second throughgoing passage.

19 Claims, 4 Drawing Sheets

(56) References Cited

U.S. PATENT DOCUMENTS

| | | | | | |
|---|---|---|---|---|---|
| 1,675,068 | A | | 6/1928 | Timbs | |
| 1,828,124 | A | | 10/1931 | Bower | |
| 2,125,762 | A | * | 8/1938 | Wheeler | 166/92.1 |
| 2,755,863 | A | * | 7/1956 | Webber et al. | 166/92.1 |
| 3,025,912 | A | | 3/1962 | Schramm | |
| 3,041,090 | A | | 6/1962 | Ashe et al. | |
| 3,831,676 | A | * | 8/1974 | Brown et al. | 166/84.2 |
| 4,041,090 | A | | 8/1977 | McClure | |
| 4,423,774 | A | * | 1/1984 | Mefford | 166/77.51 |
| 4,751,969 | A | * | 6/1988 | Klaeger | 166/369 |
| 5,121,793 | A | * | 6/1992 | Busch et al. | 166/79.1 |
| 5,875,850 | A | * | 3/1999 | Burge et al. | 166/385 |
| 6,637,515 | B2 | * | 10/2003 | Bishop et al. | 166/372 |
| 7,044,215 | B2 | * | 5/2006 | Boyles | 166/68.5 |
| 7,182,140 | B2 | * | 2/2007 | Wood | 166/379 |
| 7,308,933 | B1 | * | 12/2007 | Mayfield et al. | 166/85.1 |
| 7,810,556 | B2 | * | 10/2010 | Havinga | 166/77.3 |
| 8,176,976 | B2 | * | 5/2012 | Havinga | 166/77.2 |
| 2002/0066562 | A1 | | 6/2002 | Nice | |
| 2004/0188101 | A1 | | 9/2004 | Moretz | |
| 2008/0251248 | A1 | * | 10/2008 | Havinga | 166/77.3 |
| 2012/0138312 | A1 | * | 6/2012 | Strong | 166/377 |

OTHER PUBLICATIONS

Schlumberger Oilfield Glossary entry for "lubricator", accessed Apr. 16, 2013 via www.glossary.oilfield.slb.com.*

Heijnen, W.H.P.M, "Well Technology will shift the paradigm that production decline cannot be reversed," Sep. 2009, SPE 122822, pp. 1-14.

International Search Report and Written Opinion for PCT/EP2009/058343.

PA 2009 00974 Search Report and Written Opinion, mailed Feb. 24, 2009.

Heijnen, W.H.P.M., "The Development of Novel Down-Hole Intervention Tools, a Change in Well Technology," presented Sep. 2009, SPE 122822, pp. 1-14.

PA 2009 70053 Search Report, mailed Feb. 1, 2010.

PA 2009 70053 Office Action, mailed Feb. 4, 2010.

* cited by examiner

WIRELINE LUBRICATOR

RELATED APPLICATIONS

This application claims the benefit under 35 U.S.C. §371 of International Application No. PCT/EP2009/058343, filed Jul. 2, 2009, which claims priority to U.S. Provisional Application No. 61/080,136, filed on Jul. 11, 2008 and Danish Application No. PA 2008 00974, filed on Jul. 11, 2008, the contents of all of which are incorporated herein by reference in their entirety.

The present invention relates to a fold-down wireline lubricator. The lubricator is suitable for lubricating wirelines used in oil wells and the like.

According to one aspect, a fold-down wireline lubricator is provided. The lubricator comprising:

- a lubricator portion having one end comprising a first seal portion and a first throughgoing passage for receiving a part of a wireline, and
- a second part with a second seal portion and a second throughgoing passage for receiving a part of a wireline.

According to a second aspect, the present invention relates to a method of establishing wireline lubrication on a site employing a downhole tool. The method inter alia comprising a step of providing a fold-down wireline lubricator comprising a lubricator portion to the site, wherein the lubricator portion of the lubricator shall be capable of assuming a first configuration and a second configuration, wherein, in the first configuration, the lubricating portion is oriented substantially horizontal.

BACKGROUND

Wireline lubricators are used to lubricate wirelines as well as to hold pressure in wells wherein wirelines are lowered.

Handling of wireline lubricators etc. on drilling rigs and platforms etc. often entails extensive procedures as the facilities offered by the rigs or platforms do not always allow for vertical lifting of large components or tools. Intervention or removal of components like wireline lubricators is therefore often associated with difficulty, as the free height for such operations is limited. Further, the rig or platform seldom has means for lifting offering adequate lifting height and capacity.

Handling of e.g. a wireline lubricator on a minor rig or platform is, as a result of the above insufficiencies, often carried out by means of a mobile lifting device procured for a particular operation.

BACKGROUND ART

GB 2071599 A teach a telescopic wireline mast for oil production platforms wherein the wireline mast serves as to support a wireline lubricator. The telescopic mast comprise a base, a mast extending from the base, a first winch and pulley system for raising and lowering a lubricator and a second winch and pulley system for raising and lowering a wireline sheave. A complete wireline lubricator is proposed lay down on the deck of a platform or on the ground by effecting following steps:

- Supporting and lifting the lubricator vertically by means of the lubricator winch and pulley,
- moving the bottom of the lubricator away from the base of the wireline mast, and
- lowering the top of the lubricator until the lubricator is substantially horizontal.

In brief, the GB document proposes removal of the wireline lubricator by means of a telescopic and fairly movable and compact device for lifting the lubricator. The device also is able to lower the lubricator into a horizontal position by means of tilting the mast.

The basic function of wireline lubricators are well described in the prior art, see e.g. U.S. Pat. Nos. 1,509,906 A, 1,675,068 A, EP 0681353 B1 or EP 0681353 B1.

For the purpose of explanation and illustration, the expressions vertical and horizontal are used. The expressions only apply provided that the wireline lubricator is in an operable state, i.e. in a state wherein a later described second part being oriented substantially vertical as will be the case upon installing and connecting the connector to a bore or well.

BRIEF DESCRIPTION OF THE INVENTION

The present invention seeks to ease and improve general handling of wireline lubricators.

Up to this day, prior art has failed to teach a simple and yet reliable and inexpensive wireline lubricator which in a safe and reliable manner, without substantially increasing the weight and/or particulars of the lubricator, provides a reliable and durable wireline lubricator being easy to handle by all facilities where wireline lubrication is desired.

According to the invention, there is provided a fold-down wireline lubricator as per the introductory part of this specification, and in particular upon configuring the fold-down wireline lubricator such that the lubricator portion is pivotally connected to the second part such that the fold-down wireline lubricator is capable of assuming a first configuration and a second configuration. In the second configuration, first and second throughgoing passages are aligned and first and second seal portions engage each other to provide a sealed wireline passage defined by the aligned first and second throughgoing passages.

In other words, the problem according to the introductory part above has been solved by proposing a fold-down wireline lubricator which is adapted to disconnect the lubricator pipe from the connecting pipe while also allowing separation of the lubricator pipe with respect to the well or bore.

According to one embodiment, the lubricator portion constitutes an assembly of sub-components constituting wireline lubricator portions.

According to one embodiment, the wireline lubricator portions are loaded onto the lubricator portion when the lubricator portion is in the first configuration.

According to one embodiment, the lubricator portion defines a first centreline and the second part defines a second centreline wherein the centrelines, upon the fold-down wireline lubricator assuming the first configuration, are non-aligned.

According to one embodiment, the lubricator portion is, when arranged in the first configuration, oriented substantially horizontal.

According to one embodiment, the lubricator portion is, when arranged in the second configuration, oriented substantially vertical.

According to one embodiment, the lubricator portion is telescopic.

According to one embodiment, the first and second seal portions are disengaged in the first configuration.

According to one embodiment, the second part is connectable to a pipe.

According to one embodiment, the second part is connectable to a blow out preventer or to a well head.

According to one embodiment, during transformation between the first and second configurations, a nut operatively engaged with a threaded portion of the lubricating portion is operated.

According to one embodiment, the lubricator portion is tilt able into a substantially horizontal position by means of lifting means.

According to one embodiment, the second part comprises a body portion provided with apertures arranged such that the apertures is able to guide anti rotation bars, arranged on lubricating portion, in one or more directions.

According to one embodiment, the apertures are in one end open allowing the lubricating portion incl. the anti rotation bars to be removed from the body portion of the second part.

According to one embodiment, an actuator is provided for effectuating shift between first and second configurations.

According to one embodiment of the second aspect of the present invention, the method further comprises a step of, in the first configuration, assembling the lubricator portion from sub-components constituting wireline lubricator portions.

According to one embodiment of the second aspect of the present invention the method further comprises a step of rotating the lubricator portion into the second configuration.

According to one embodiment of the second aspect of the present invention the lubricator portion is, when arranged in the second configuration, oriented substantially vertical.

The figures serve the purpose of illustration only and may not be considered limiting for the scope of the invention as such. Further the figures are conveniently scaled to fit the purpose of this specification.

DETAILED DESCRIPTION WITH REFERENCE TO THE FIGURES

Figure 1:
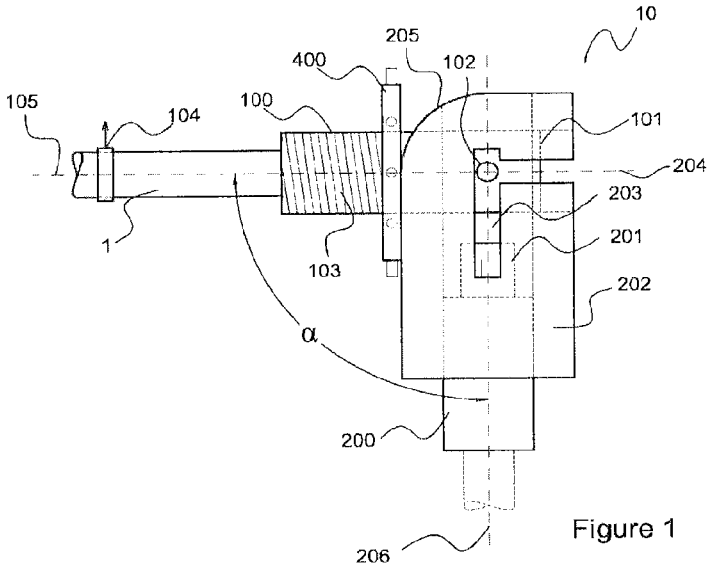
FIG. 1 illustrates a principal side view of a connector for a wireline lubricator in a first configuration.

FIG. 1 shows a connector 10 for a wireline lubricator. The connector 10 is shown in a first configuration wherein the first part 100, which may form part of a wireline lubricator or not, is oriented substantially horizontal, and wherein the second part 200 is oriented substantially vertical.

One portion of the first part or wireline lubricator 100 may be provided with threads 103 being able to engage with a nut 400.

Figure 2:
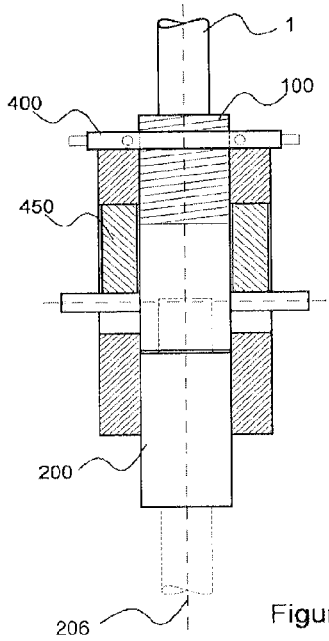
FIG. 2 illustrates a principal sectional view of a connector for a wireline lubricator in a second configuration.
Figure 3:
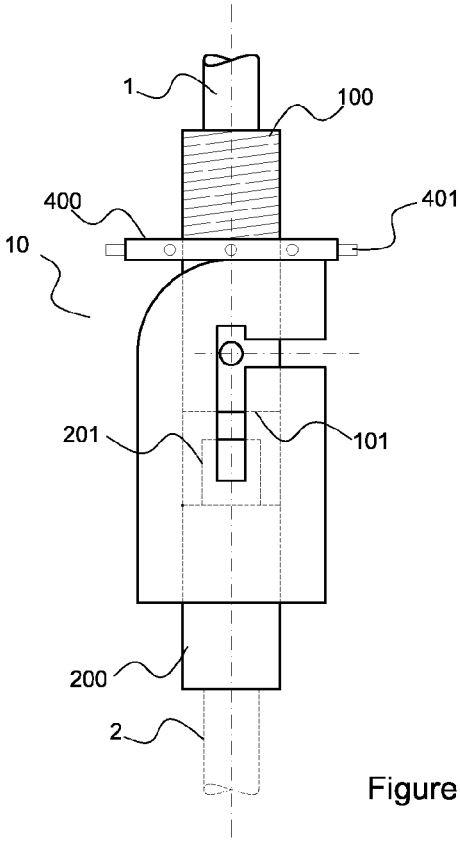
FIG. 3 illustrates a principal side view of a connector for a wireline lubricator where the first part is oriented vertically, and is not in sealed connection with the second part.

Operation of the nut 400, upon the connector 10 being arranged in a second configuration, e.g. according to FIG. 2, entails either lifting or lowering of the first part or wireline lubricator 100 within the second part 200.

Figure 4:
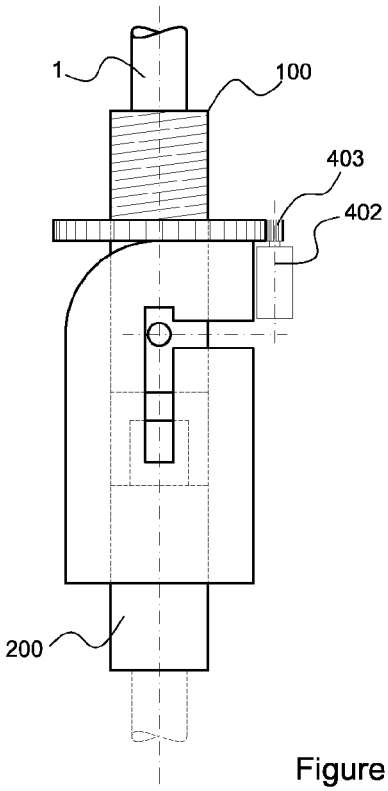
FIG. 4 illustrates a principal side view of a connector for a wireline lubricator incl. operating means.

The nut 400 may comprise various means 401, 402 accommodating easy operation of the connector 10, e.g. powered means 402 (FIG. 4) which, e.g. by electrical power, hydraulic pressure or equivalent, forces the nut 400 in a desired direction of rotation. The nut 400 may further comprise, in combination with the powered means 402 or not, stubs or handles 401 accommodating easy operation of the nut 400 by hand or other manual operation.

The first part or wireline lubricator 100 is in one end 101 configured to receive the second part 200 and form a sealed connection with the second part 200. The end 101 of the first part or wireline lubricator 100 may be arranged such that it is able to receive a stub 201 protruding from the second part 200.

The opposite end of the first part 100, in embodiments wherein the connector does not form part of a wireline lubricator, may be adapted to connect, directly or indirectly, with a lubricator pipe 1.

The second part 200, which in one end may be connected to a connecting pipe 2 or equivalent, comprising, in an opposite end, a stub 201 prepared for engagement with the end 101 of the first part or wireline lubricator 100. Further, the second part 200 comprise a body portion 202 provided with elongated apertures; two substantially vertical apertures 203, and two substantially horizontal apertures 204, all of which serves as guides for anti rotation bars 102, which through the apertures 203, 204, is attached to the first part or wireline lubricator 100.

Figure 5:
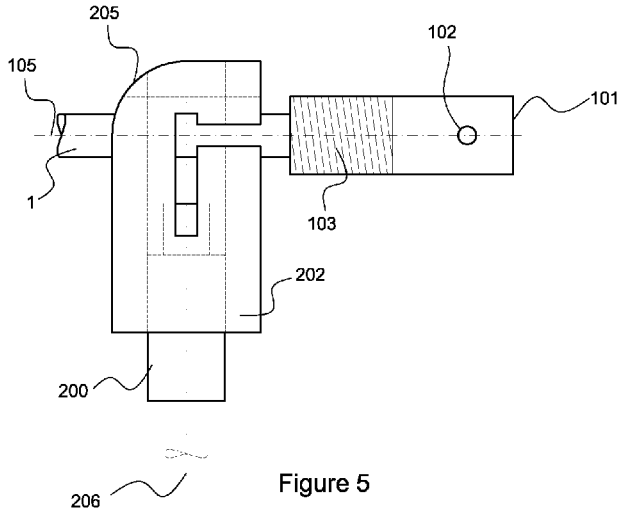
FIG. 5 illustrates a principal side view of a connector for a wireline lubricator wherein the first part is partially withdrawn from the second part.

The vertical apertures 203 maintain a substantial horizontal centre of rotation of the anti rotation bars 102 during tilting of the first part or wireline lubricator 100, and further, the apertures 204 allow the first part or wireline lubricator 100 to be horizontally set apart by dislocation, see FIG. 5.

An upper portion of the second part 200 may be provided with a chamfer or fillet 205 having a curvature configured for supporting the underside of the nut 400 during tilting of the first part or wireline lubricator 100.

The parts 100 and 200 define first and second throughgoing passages.

Blocks 450 may be inserted into the vertical apertures 203, above the anti rotation bars 102, when the first part or wireline lubricator 100 and the second part 200 is in the second configuration, wherein first and second throughgoing passages, as illustrated by the lubricator centreline 105 and the second part centerline 206 in the figures, are aligned and wherein first and second seal portions 101, 201 engage each other to provide a sealed wireline passage. Upon placing the blocks 450 in the apertures 203, the nut 400 may be operated in a direction wherein the blocks 450 are secured and any backlash between the parts 100, 200 is eliminated.

The connector 10 may be operated as per the below exposition. Further, the below recital is applicable for removal of the wireline lubricator i.e. shifting the connector 10 from the second configuration to the first configuration.

- any blow out preventers are closed;
- the nut 400 is operated in a direction resulting in a slight lift of the wireline lubricator or first part 100,
- the lock blocks 450 are removed,
- the nut 400 is further operated in a direction resulting in the end 101 of the first part or wireline lubricator 100 disengaging the stub 201 arranged on the second part 200,
- the first part or wireline lubricator 100 incl. the nut 400 is by means of the lifting means present on the site or incorporated into the connector 10 or wireline lubricator, laid in a substantially horizontal position by tilting. The centre of rotation of the tilt is defined by the anti rotation bars 102. During the tilting operation, the weight and forces originating from the first part or wireline lubricator 100 incl. the nut 400 etc. may be conveyed to curved portion 205 of the second part via the nut 400, the wireline lubricator may be assembled or disassembled by fitting or removing lubricator portions 301, see FIG. 6, and tools may be loaded or unloaded from the well or bore.

If the nut 400 is removed from the first part or wireline lubricator 100, it is possible to at least partially remove the first part or wireline lubricator 100 and the anti rotation bars 102 from the body portion 202 of the second part 200. This is may be accomplished by moving the first part or wireline lubricator 100 horizontally by guiding the anti rotation bars 102 through the horizontal aperture 204, see FIG. 5.

The first part or wireline lubricator 100 may be provided with means 104 facilitating tilting of the first part or wireline lubricator 100 by means of onsite lifting means, which could constitute only a simple block and pulley assembly or any available crane. Alternatively, the first part or wireline lubricator 100 may accommodate lifting means e.g. in the form of a winch or an actuator, whereby tilting of the first part or wireline lubricator 100 merely requires an immobile structure for fastening of a cable rope.

Another alternative enabling tilting of the first part or wireline lubricator 100 may constitute an arrangement comprising one or more cylinders/rams and/or mechanical mechanisms incorporating gears etc.

The nut 400, which engages the threaded portion 103 of the first part or wireline lubricator 100, may be substantially circular comprising means assisting the operation, i.e. lifting or lowering of first part or wireline lubricator 100. The means could be in the form of a drive or motor 402, connected e.g. by a toothed gear or a friction drive 403 to the nut 400. Alternatively, the substantially circular shape of the nut 400 may be replaced by any geometrical form facilitating means gripping the nut 400, e.g. a hexagon shape etc. The nut 400 incl. its surfaces, should have sufficient strength allowing for forces originating from the first part or wireline lubricator 100 incl. the nut 400 itself to be transferred to the curved portion 205 of the second part 200.

While a nut 400 is proposed lifting and lowering the first part or wireline lubricator 100 via threads 103, this shall not be considered an essential feature of the present invention. Other alternatives of lifting and lowering the first part or wireline lubricator 100 may equally by applied, e.g. ball threading or hydraulic/electric/mechanical clamping means etc.

The first part 100 may or may not form part of a wireline lubricator. In embodiments wherein the first part does not form part of a wireline lubricator, the part may suitably be prepared to be connected to a wireline lubricator.

The first part 100 may constitute a substantially circular elongated part haven an end 101 comprising a hollow adapted to receive a stud 201, arranged on the second portion 200, in order to connect the connecting pipe 2 with the pipe 1. Alternatively, the opposite end 101 of the first part or wireline lubricator 100 may comprise a stud (not shown) configured for connecting with a hollow arranged within the second part 200 (not shown).

The first part or wireline lubricator 100 is, as per the above, provided with threads 103 extending from its upper portion towards the opposite end 101. The threads 103 may extend in the entire length of the first part or wireline lubricator 100 or extend in any length there between. In the illustrated embodiments, the threads 103 extend over abt. 50% of the length of the first part or wireline lubricator 100; however this may in no way be considered limiting for the present invention.

The rise and depth of the threads 103 may be suitable selected from standard or non-standard threading systems.

The first part or wireline lubricator 100 may be fitted with anti rotation bars 102 constituting elongated members oriented crosswise in the longitudinal direction of the first part or wireline lubricator 100. The anti rotation bars 102 are rigidly fixed to the first part or wireline lubricator 100 and primarily serves three purposes:

preventing rotation or the first pert or wireline lubricator 100, e.g. when the nut 400 is operated, defining and maintaining a centre of rotation during tilting of the first part or wireline lubricator 100, and guiding the first part or wireline lubricator 100 in multiple directions upon removing the first part or wireline lubricator 100 incl. pipe 1 from the body portion 202 of the second part 200.

Means for sealing (not shown) may be provided for sealing between the parts 100, 200. Selecting suitable sealing techniques are considered a triviality, and will not be subject for further discussion within this specification.

The second part 200 may constitute a substantially circular elongated part having one end adapted to connect with a pipe 2 or equivalent and comprising a stud 201 configured for connecting with a hollow arranged in an end 101 of the first part or wireline lubricator 100. Alternatively, the second part 200 may be adapted to receive a stud (not shown) protruding from the first part or wireline lubricator 100, in a hollow (not shown) in order to connect the pipe 2 with the pipe 1.

The body portion 202 of second part 200 may be provided with an opening adapted to receive the first part or wireline lubricator 100 incl. anti rotation bars 102. The opening for receiving the first part or wireline lubricator 100 is made such that a loose fit between the surface of the first part or wireline lubricator 100 and the opening is achieved allowing the first part or wireline lubricator 100 to slide or move within the body portion 202.

The connector 10 may include means for testing the integrity of the seal.

The connecting pipe 2 may be connected to a blow out preventer or to a well-head or equivalent.

Figure 6:
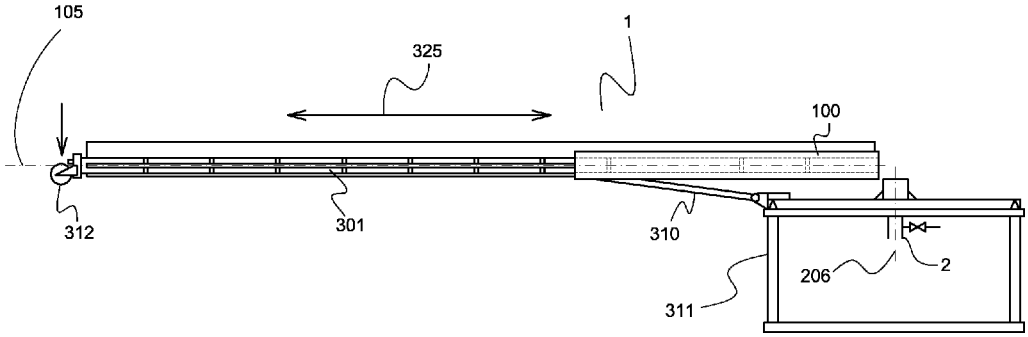
FIG. 6 illustrates a side view of a wireline lubricator in a first configuration.

FIG. 6 illustrates a side view of a wireline lubricator in a first configuration, i.e. in a position wherein the wireline lubricator is oriented substantially horizontal. In this embodiment, the wireline lubricator 100 is shown without the connector according to the above exposition. As can be seen in the figure, the lubricating portion 100 of the wireline lubricator may constitute an assembly of subsections 301. The subsections 301 constitute minor sections of wireline lubricators which, upon assembly, may make up a full or complete wireline lubricator.

The subsections 301 may have a length typically between 0.5 to 4 meters, or 1.5 to 3 meters.

As can be seen, the subsections 301 are connected to each other in series, and further, the lubricator may, in the end defining a centre of rotation of the wireline lubricator, may be provided with a block 312.

Further as can be seen in FIG. 6, the wireline lubricator may be provided with means 310 for obtaining rotation or tilt of the wireline lubricator. The means 310 may constitute an actuator, hydraulic cylinder or equivalent with one end connected to an immobile structure 311, and the opposite end is connected to the wireline lubricator or a part thereof.

The immobile structure 311 may form part of a platform, rig or equivalent.

As illustrated by the arrow referenced on FIG. 6 by numeral 325, the overall length, and thereby also the height, of the wireline lubricator may vary inter alia via translation in the direction of the arrow 325, either via telescopic behaviour, or simply by adding or removing sections of the wireline lubricator pipe.

Figure 7:
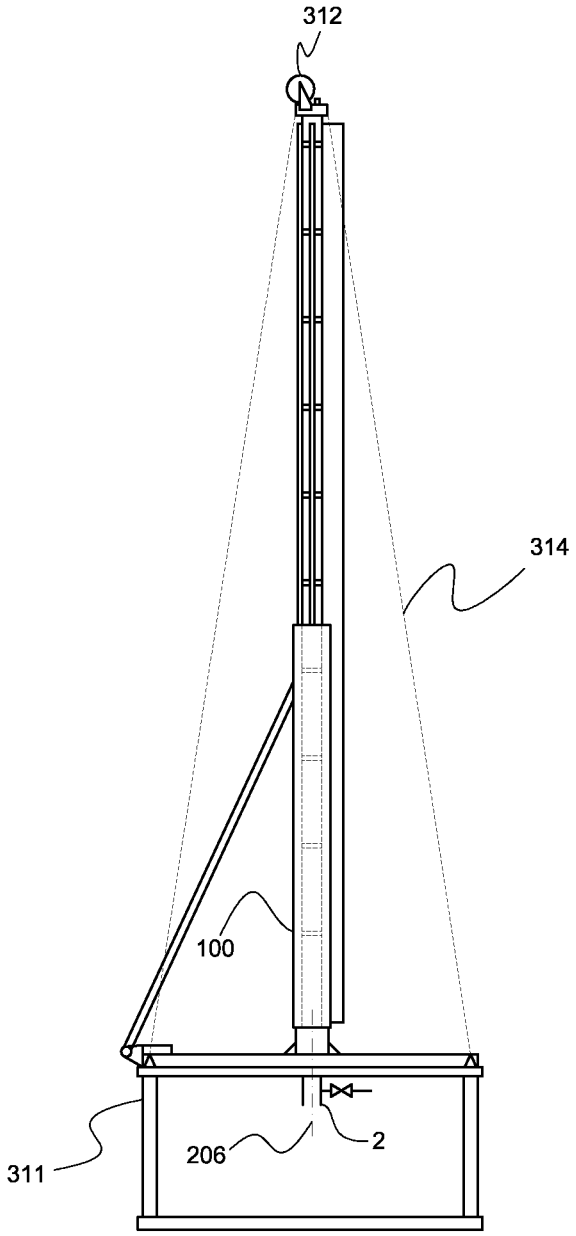
FIG. 7 illustrates a side view of a wireline lubricator in a second configuration.

FIG. 7 illustrates a side view of a wireline lubricator in a second configuration, i.e. in a position wherein the wireline lubricator is oriented substantially vertical.

The wireline lubricator may, as indicated by numeral 314 identifying ropes or wires, be secured in the vertical or upright position by means of various arrangements such as rods, ropes or wires etc.

Numeral 2 may, as already mentioned earlier in the specification, be connected to a blow out preventer, BOP, or equivalent.

By the expression "fold-down" is, throughout this specification incl. claims, meant an ability to lay down, translate, tilt or rotate in one plane such that a structure may assume another angular orientation. Further, the expression "fold-down" is also, throughout this specification incl. claims, meant to denote an opposite action of aforesaid expression "fold-down".

The components of the connector and wireline lubricator may be fabricated from any suitable kind of steel or cast iron and the like, and the components can either be manufactured in a moulding process or via machining. The surfaces of areas which are subjected to sliding contact, e.g. the nut 400, the curvatures 205 and the surfaces of the apertures 203, 204 may be hardened or provided with surface layers reinforcing the strength of the surfaces in order to avoid seizing etc.

The invention claimed is:

1. A fold-down wireline lubricator comprising:

a lubricator portion having one end comprising a first seal portion and a first through-going passage for receiving a part of a wireline, and a second part with a second seal portion and a second through-going passage for receiving a part of a wireline, wherein said lubricator portion being pivotally connected to said second part such that said fold-down wireline lubricator is capable of assuming a first configuration and a second configuration, wherein in said second configuration said first and second through-going passages are aligned and said first and second seal portions engage each other to provide a sealed wireline passage defined by said aligned first and second through-going passages, wherein a pair of anti rotation bars extend outwardly from opposite sides of the outer surface of the end the lubricator portion that comprises the first seal portion, wherein said second part comprises a body portion that includes a pair of vertically arranged apertures and a pair of horizontally arranged apertures on opposing sides of said body portion, wherein said vertically and horizontally arranged apertures intersect one another, and wherein said horizontally arranged apertures extend to respective edges of the body portion to provide openings that facilitate entry of the anti rotation bars into the horizontally arranged apertures.

2. The fold-down wireline lubricator according to claim 1, wherein said lubricator portion comprises an assembly of lubricator sub-component sections.

3. The fold-down wireline lubricator according to claim 2, wherein the sub-component sections are added to said wireline lubricator wherein said lubricator portion is in said first configuration.

4. The fold-down wireline lubricator according to claim 1, wherein said lubricator portion defines a first centre line and said second part defines a second centre line wherein said centre lines, upon said fold-down wireline lubricator assuming said first configuration, is nonaligned.

5. The fold-down wireline lubricator according to claim 1, wherein said lubricator portion, when arranged in said first configuration, is oriented substantially horizontal.

6. The fold-down wireline lubricator according to claim 1, wherein said lubricator portion, when arranged in said second configuration, is oriented substantially vertical.

7. The fold-down wireline lubricator according to claim 1, wherein said lubricator portion is telescopic.

8. The fold-down wireline lubricator according to claim 1, wherein said first and second seal portion are disengaged in said first configuration.

9. A fold-down wireline lubricator according to claim 1, wherein said second part is connectable to a pipe.

10. A fold-down wireline lubricator according to claim 1 wherein said second part is connectable to a blow out preventer or to a well head.

11. The fold-down wireline lubricator according to claim 1, wherein during transformation between said first and second configurations, a nut operatively engaged with a threaded portion of said lubricating portion is operated.

12. The fold-down wireline lubricator according to claim 1 further comprising lifting means configured to tilt lubricator portion into a substantially horizontal position.

13. A fold-down wireline lubricator according to claim 1, wherein said openings formed by said horizontally arranged apertures allow removal of said lubricator portion and said anti rotation bars from said body portion of said second part.

14. The fold-down wireline lubricator according to claim 1, wherein an actuator is provided for effectuating shift between said first and said second configurations.

15. A method of establishing wireline lubrication on a site employing a down-hole tool comprising:

providing a fold-down wireline lubricator at a top of a well, the wireline lubricator comprising:

a lubricator portion, said lubricator portion being capable of assuming a first configuration and a second configuration, wherein in said first configuration, said lubricating portion is oriented substantially horizontal; and a second part with a second seal portion and a second through-going passage for receiving a part of a wireline, wherein said lubricator portion is pivotally connected to said second part such that said fold-down wireline lubricator is capable of assuming said first configuration and said second configuration, wherein in said second configuration said first and second through-going passages are aligned and said first and second seal portions engage each other to provide a sealed wireline passage defined by said aligned first and second through-going passages, wherein a pair of anti rotation bars extend outwardly from opposite sides of the outer surface of the end the lubricator portion that comprises the first seal portion, wherein said second part comprises a body portion that includes a pair of vertically arranged apertures and a pair of horizontally arranged apertures on opposing sides of said body portion, wherein said vertically and horizontally arranged apertures intersect one another, and wherein said horizontally arranged apertures extend to respective edges of the body portion to provide openings that facilitate entry of the anti rotation bars into the horizontally arranged apertures; and lowering at least one wireline into the well via the wireline lubricator, wherein the wireline lubricator lubricates the wireline and maintains a well pressure.

16. The method according to claim 15, further comprising: in said first configuration, assembling said lubricator portion from an assembly of lubricator sub-components sections.

17. The method according to claim 16, further comprising rotating said lubricator portion into said second configuration.

18. The method according to claim 15, wherein said lubricator portion is, when arranged in said second configuration, oriented substantially vertical.

19. The method according to claim 16, wherein said lubricator portion is, when arranged in said second configuration, oriented substantially vertical.

* * * * *